US005526908A

United States Patent [19]

Wang

[11] Patent Number: 5,526,908

[45] Date of Patent: Jun. 18, 1996

[54] RETRACTABLE HANDLE ASSEMBLY FOR A SUITCASE

[76] Inventor: King-Sheng Wang, No. 17, Lane 116, Ta An Gan Rd., Tachia Chen, Taichung Hsien, Taiwan

[21] Appl. No.: 362,259

[22] Filed: Dec. 22, 1994

[51] Int. Cl.[6] ..... A45C 5/14; A45C 13/22; A45C 13/26; A45C 13/36

[52] U.S. Cl. ..... 190/115; 190/18 A; 190/39; 190/127; 16/115; 280/37; 280/655

[58] Field of Search ..... 190/115, 117, 190/18 A, 127, 39; 280/37, 655, 655.1; 16/115

[56] References Cited

U.S. PATENT DOCUMENTS

| | | | |
|---|---|---|---|
| 3,257,120 | 6/1966 | Browning | 190/18 A X |
| 4,254,850 | 3/1981 | Knowles | 190/18 A |
| 4,792,025 | 12/1988 | Thomas | 190/115 X |
| 4,974,871 | 12/1990 | Mao | 280/655 X |
| 5,167,306 | 12/1992 | Carrigan, Jr. | 190/18 A |
| 5,291,976 | 3/1994 | Ku | 190/117 X |
| 5,374,073 | 12/1994 | Hung-Hsin | 280/655 X |
| 5,377,795 | 1/1995 | Berman | 190/18 A |

*Primary Examiner*—Sue A. Weaver
*Attorney, Agent, or Firm*—Poms, Smith, Lande & Rose

[57] ABSTRACT

A retractable handle assembly for a suitcase includes a hollow bracket mounted on a top plate of one of the half bodies thereof, a pair of lug portions each formed on one of the distal end portions of the bracket and each having a first bore laterally defined therein, a pair of outer tubes each securely mounted between the lug portion and a bottom plate of the half body and each having a second bore laterally defined therein for aligning with the first bore, a pair of inner tubes each slidably mounted in one of the outer tubes and each having a third bore laterally defined therein for aligning with the second bore, a substantially U-shaped handle portion mounted on the bracket and having two free end portions each fixedly engaged with the upper end of a corresponding one of the inner tubes, a pressing member movably mounted in the hollow bracket and including a knob extending through an opening of the hollow bracket, a biasing member mounted on an underside of the pressing member and including a pair of stubs each respectively extending through the first bore of associated lug portion, the second bore of associated outer tube and the third bore of associated inner tube.

4 Claims, 5 Drawing Sheets

RETRACTABLE HANDLE ASSEMBLY FOR A SUITCASE

BACKGROUND OF THE INVENTION

1. Field of Invention

The present invention relates to a retractable handle assembly, and more particularly to a retractable handle assembly for a suitcase.

2. Related Prior Art

A conventional suitcase usually comprises a suitcase body fixed on a base which has four wheels located thereunder, thereby allowing a user to pull a handle portion thereof so as to pull the suitcase. Normally, the handle portion is installed at an upper part of the suitcase body, so easily incurring a difficulty for the user on pulling the suitcase in a balanced way especially when the user changes a displacing direction of the suitcase. Therefore, it is requisite to provide an improved handle assembly which is normally in a hidden status, thereby being allowed to be extended to pull the suitcase.

The present invention has arisen to mitigate and/or obviate the above-mentioned disadvantages of the conventional handle assembly.

SUMMARY OF THE INVENTION

The primary objective of the present invention is to provide a retractable handle assembly for a suitcase, which is easily expanded and folded without exerting much force thereon.

In accordance with one aspect of the present invention, there is provided a retractable handle assembly for a suitcase which comprises a pair of half bodies which are detachably coupled together, a pair of holes defined in a top plate of one of the pair of half bodies, the handle assembly comprising a hollow bracket mounted on the top plate of one of the half bodies, an opening defined in an upperside of the bracket, a pair of lug portions each formed on one of the distal end portions of the bracket and extending downwardly to be received in a corresponding one of the holes of associated top plate, a passage vertically defined in each of the lug portions, a first bore laterally defined in each of the lug portions, a pair of outer tubes each having an upper end securely received in the passage of a corresponding one of the lug portions and having a lower end fixed to a bottom plate of associated half body, a second bore laterally defined in the upper end of each of the outer tubes and aligning with the first bore of associated lug portion, a pair of inner tubes each slidably mounted in one of the outer tubes, a third bore laterally defined in the upper end of each of the inner tubes and aligning with the second bore of associated outer tube, a substantially U-shaped handle portion mounted on the bracket and having two free end portions each fixedly engaged with the upper end of a corresponding one of the inner tubes, a pressing member movably mounted in the hollow bracket and comprising a knob extending through the opening of the hollow bracket and projecting upwardly therefrom, a biasing member mounted on an underside of the pressing member and comprising a pair of stubs each respectively extending through the first bore of associated lug portion, the second bore of associated outer tube and the third bore of associated inner tube, whereby, the knob of the pressing member is vertically movable between a first position where each of the stubs of the biasing member is inserted into associated third bore of the inner tube, thereby locking each of the inner tubes in place, and a second position where each of the stubs of the biasing member is detached from associated the third bore of the inner tube such that each of the inner tubes is movable in associated the outer tube.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
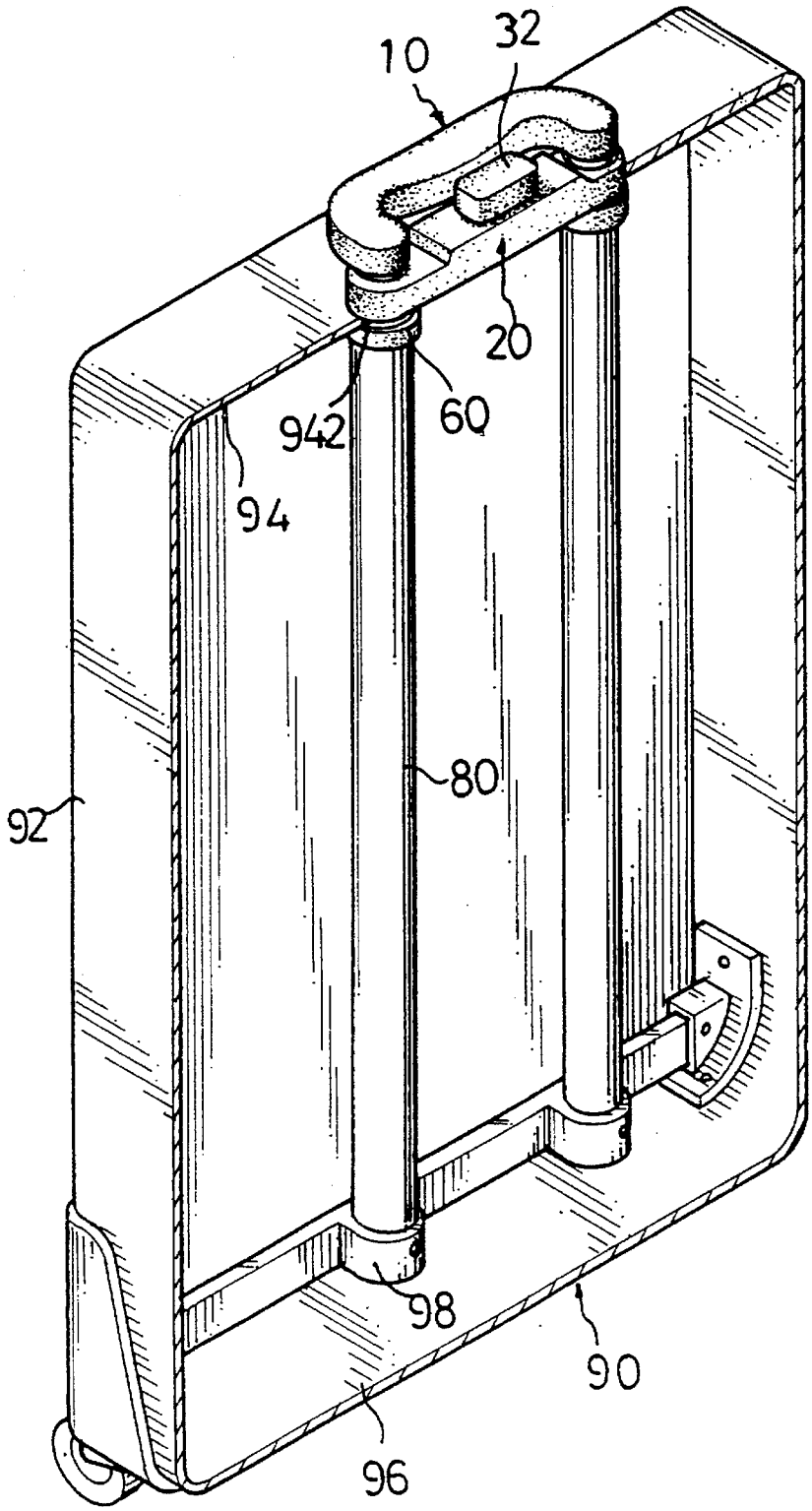
FIG. 1 is a perspective view of a retractable handle assembly for a suitcase in accordance with the present invention.

Referring to the drawings, and initially to FIG. 1, a retractable handle assembly in accordance with the present invention is provided for a suitcase 90 which comprises a pair of pair of half bodies 92 (only one half body is shown) which are detachably coupled together, each of the half bodies 92 has a top plate 94 and a bottom plate 96, and a pair of holes 942 are defined in the top plate 94 of one of the pair of half bodies 92.

Figure 2:
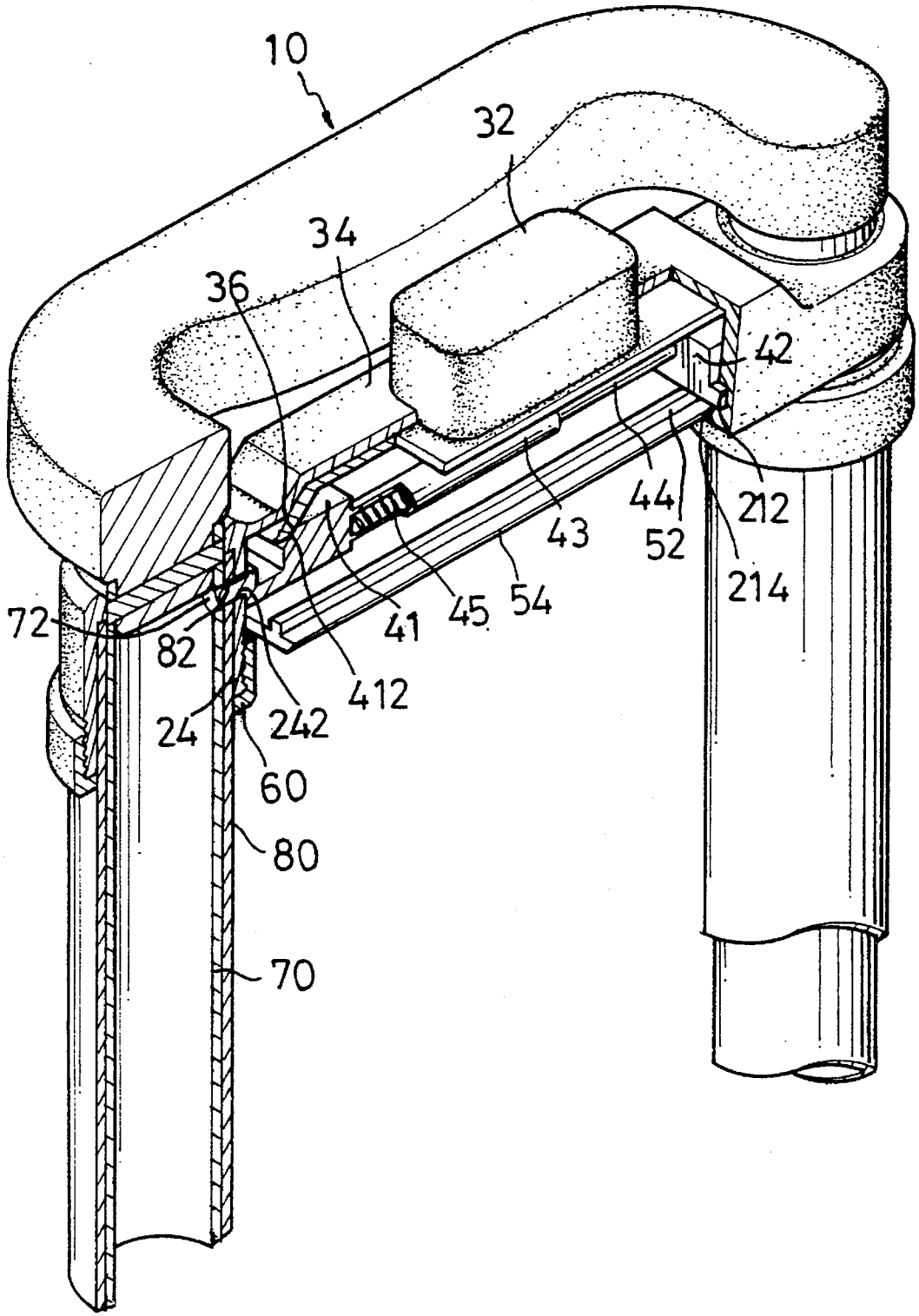
FIG. 2 is a partially enlarged cross-sectional view of the retractable handle assembly as shown in FIG. 1.
Figure 3:
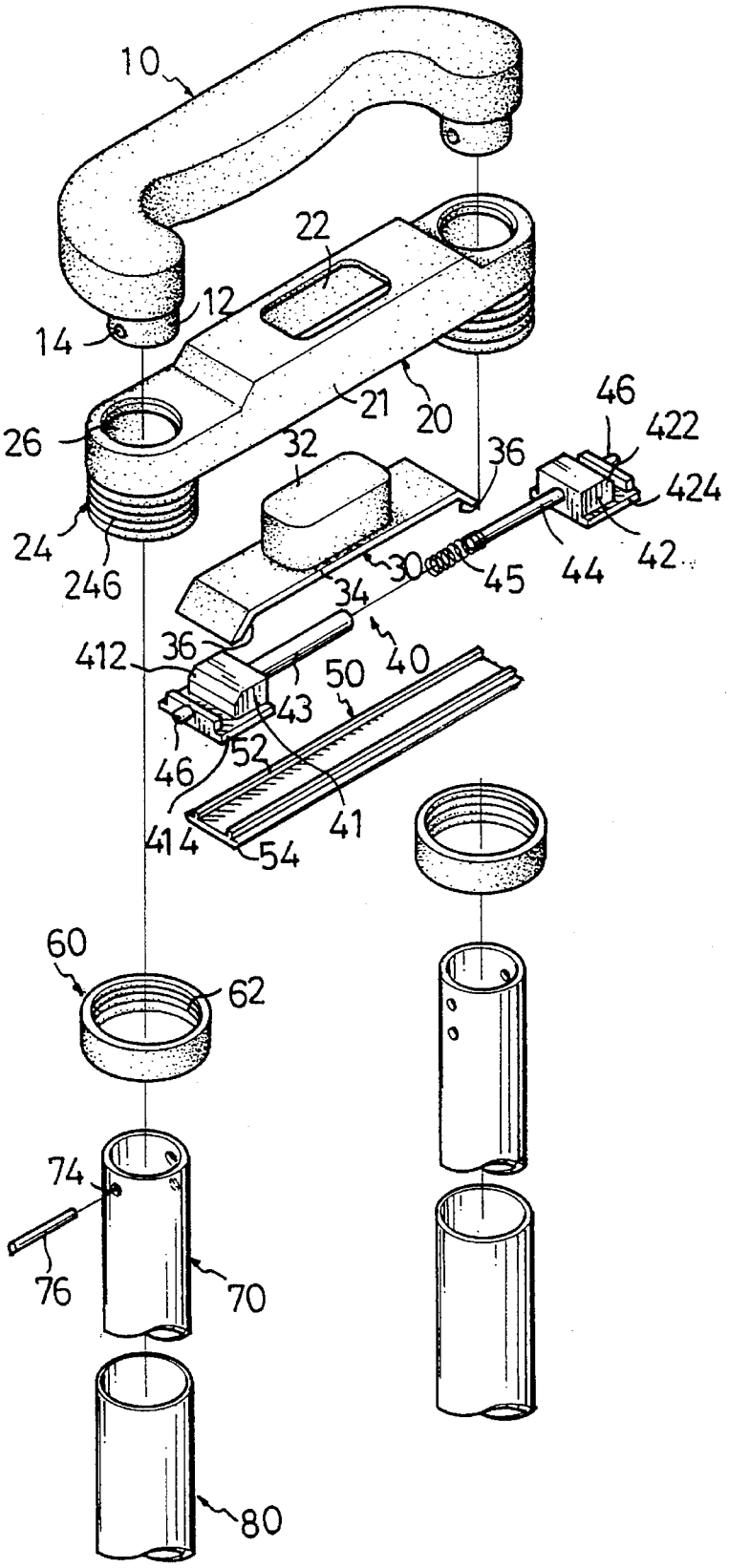
FIG. 3 is an exploded view of the handle assembly.

Referring to FIGS. 2 and 3 with reference to FIG. 1, the handle assembly comprises a hollow bracket 20 mounted on the top plate 94 of the half body 92 with the pair of holes 942 and having two side walls 21 and two distal end portions, an opening 22 is defined in an upperside of the bracket 20, a pair of lug portions 24 are each formed on one of the distal end portions of the bracket 20 and each extend downwardly to be securely received in a corresponding one of the two holes 942 of the top plate 94, a passage 26 is vertically defined in each of the two lug portions 24, and a first bore 242 is laterally defined in each of the two lug portions 24. A pair of outer tubes 80 each have an upper end securely received in the passage 26 of a corresponding one of the two lug portions 24 and each have a lower end fixed to the bottom plate 96 of the associated half body 92 with the pair of holes 942, and a second bore 82 is laterally defined in the upper end of each of the outer tubes 80 and aligning with the first bore 242 of the associated lug portion 24. It is appreciated that the upper end of each of the two outer tubes 80 is stopped by an upperside of the associated lug portion 24, thereby fixing each of the two outer tubes 80 in the associated lug portion 24. Preferably, on the bottom plate 96 of the half body 92 with the pair of holes 942 are formed a pair of sockets 98 in each of which the lower end of the associated outer tube 80 is securely received. Each of the two lug portions 24 has an outer threading 246, and a pair of compressing members 60 are each mounted around a corresponding one of the two outer tubes 80 and each have an inner threading 62 threadedly engaged on the outer threading 246 of the associated lug portion 24, thereby securely mounting the bracket member 20 on the top plate 94 of the associated half body 92 with the pair of holes 942.

A pair of inner tubes 70 each are slidably mounted in one of the two outer tubes 80 and each have an upper end and a lower end, and a third bore 72 is laterally defined in the upper end of each of the inner tubes 70 and aligning with the second bore 82 of the associated outer tube 80. A substantially U-shaped handle portion 10 is releasably mounted on the bracket 20 and has two free end portions, and a pair of protrusions 12 are each formed on one of the free end portions of the handle portion 10 and extend downwardly therefrom and are each fixedly engaged in the upper end of a corresponding one of the two inner tubes 70. Preferably, each of the two protrusions 12 has a hole 14 transversely defined therethrough, a pair of holes 74 are transversely defined in the upper end of each of the inner tubes 70 and align with the horizontal hole 14 of the associated protrusion 12, and a pair of pins 76 each extend through the holes 74 of the associated inner tube 70 and the horizontal hole 14 of the associated protrusion 12, thereby securely attaching the handle portion 10 to the two inner tubes 70.

A pressing member 30 is movably mounted in the hollow bracket 20 and includes a button 32 extending through the opening 22 of the hollow bracket 20 and projecting upwardly therefrom. A biasing member 40 is mounted on an underside of the pressing member 30 and includes a pair of stubs 46 each respectively extending through the first bore 242 of a corresponding one of the two lug portions 24, the second bore 82 of the associated outer tube 80 and the third bore 72 of the associated inner tube 70, whereby, the button 32 of the pressing member 30 is vertically movable between a first position where each of the stubs 46 of the biasing member 40 is inserted into the associated third bore 72 of the inner tube 70, thereby locking each of the two inner tubes 70 in place, and a second position where each of the two stubs 46 of the biasing member 40 is detached from the associated third bore 72 of the inner tube 72 such that each of the two inner tubes 70 is movable in the associated outer tube 80.

The biasing member 40 comprises a first block 41 and a second block 42 movable horizontally toward each other in the hollow bracket 20, a first tapered surface 412 and a second tapered surface 422 are respectively formed on the first and second blocks 41 and 42 and face outwardly opposite to each other, each of the stubs 46 is respectively formed on a free end of the first and second blocks 41 and 42 and faces outwardly opposite to each other, a receiving tube 43 is formed on the first block 41 and faces toward the second block 42, a linking rod 44 is formed on the second block 42 and is received in the receiving tube 43 of the first block 41, a spring 45 is securely attached to a free end of the linking rod 44 and is urged in the receiving tube 43 and biased against the first block 41, the pressing member 30 a comprises a plate 34 formed on an underside of the button 32, a pair of slant surfaces 36 are each respectively formed on a corresponding distal end of the plate 34 and each extend downwardly to be respectively rested on the first tapered surface 412 of the first block 41 and the second tapered surface 422 of the second block 42, whereby, when the button 32 is pressed downwardly, the first and second blocks 41 and 42 are forced to move toward each other by means of sliding engagement between the slant surfaces 36 and the first and second tapered surfaces 412 and 422, thereby detaching each of the two stubs 46 from the associated third bore 72 of the inner tube 70.

A first sliding base 414 and a second sliding base 424 are respectively formed on an underside of the first and second blocks 41 and 42, and the hollow bracket 20 comprises an elongated guiding groove 212 (see FIG. 2) laterally defined in each of the two side walls 21 thereof for receiving and guiding the first and second sliding bases 414 and 424 therein. A support member 50 is securely mounted in an underside of the hollow bracket 20, and a pair of elongated flanges 52 is longitudinally formed on an upperside of the support member 50 and protrudes upwardly therefrom for securely supporting the first and second sliding bases 414 and 424 thereon. Preferably, an elongated upward-facing tapered face 214 (see FIG. 2) is laterally formed on an underside of each of the two side walls 21 of the bracket member 20, and an elongated downward-facing tapered face 54 is laterally formed on each of two sides of the support member 50 for securely urging on the associated upward-facing tapered face 214 such that the support member 50 is fixedly mounted in the underside of the hollow bracket 20.

Figure 4:
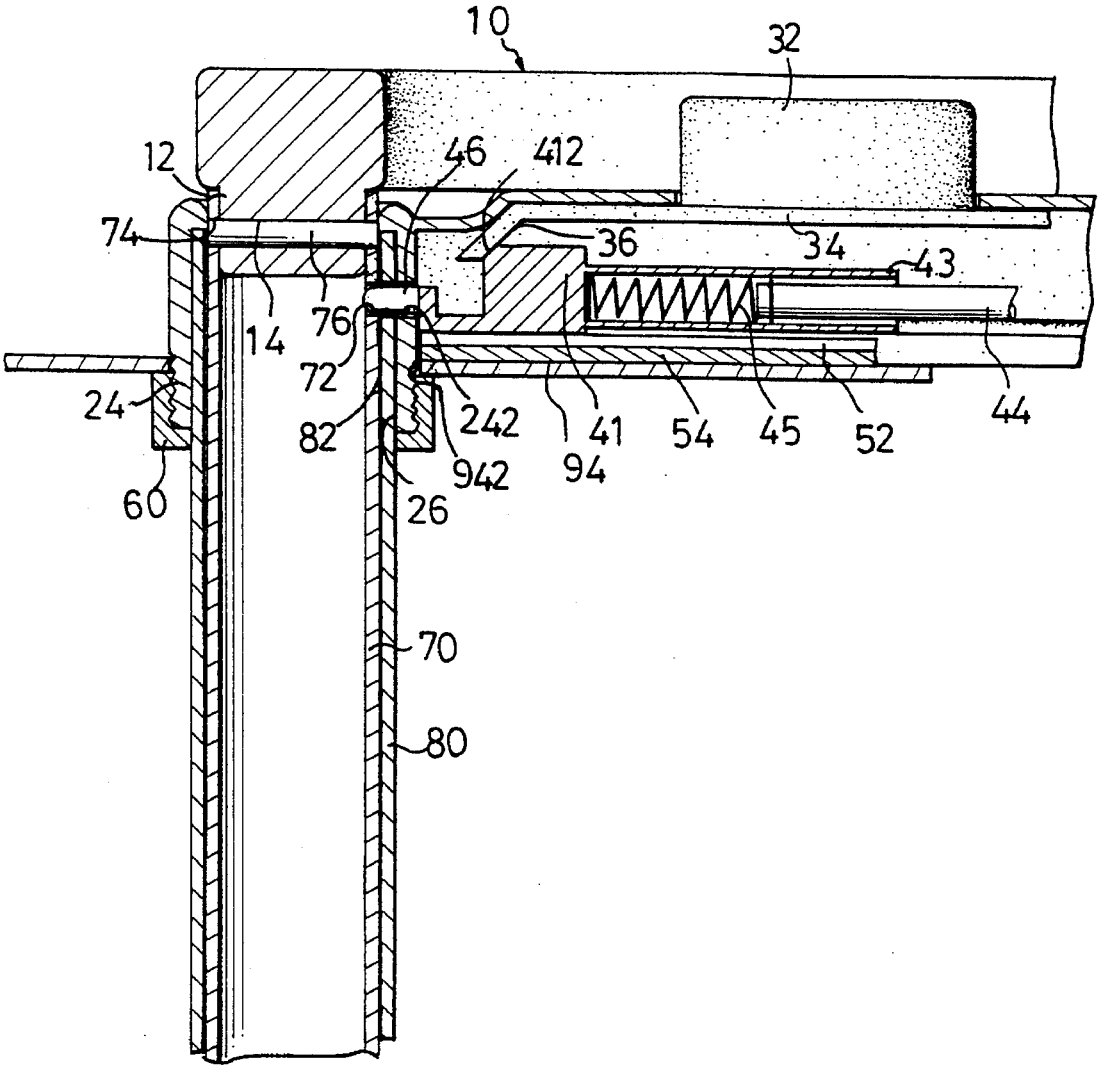
FIG. 4 is an operational view showing an inner tube of the handle assembly being locked in position.
Figure 5:
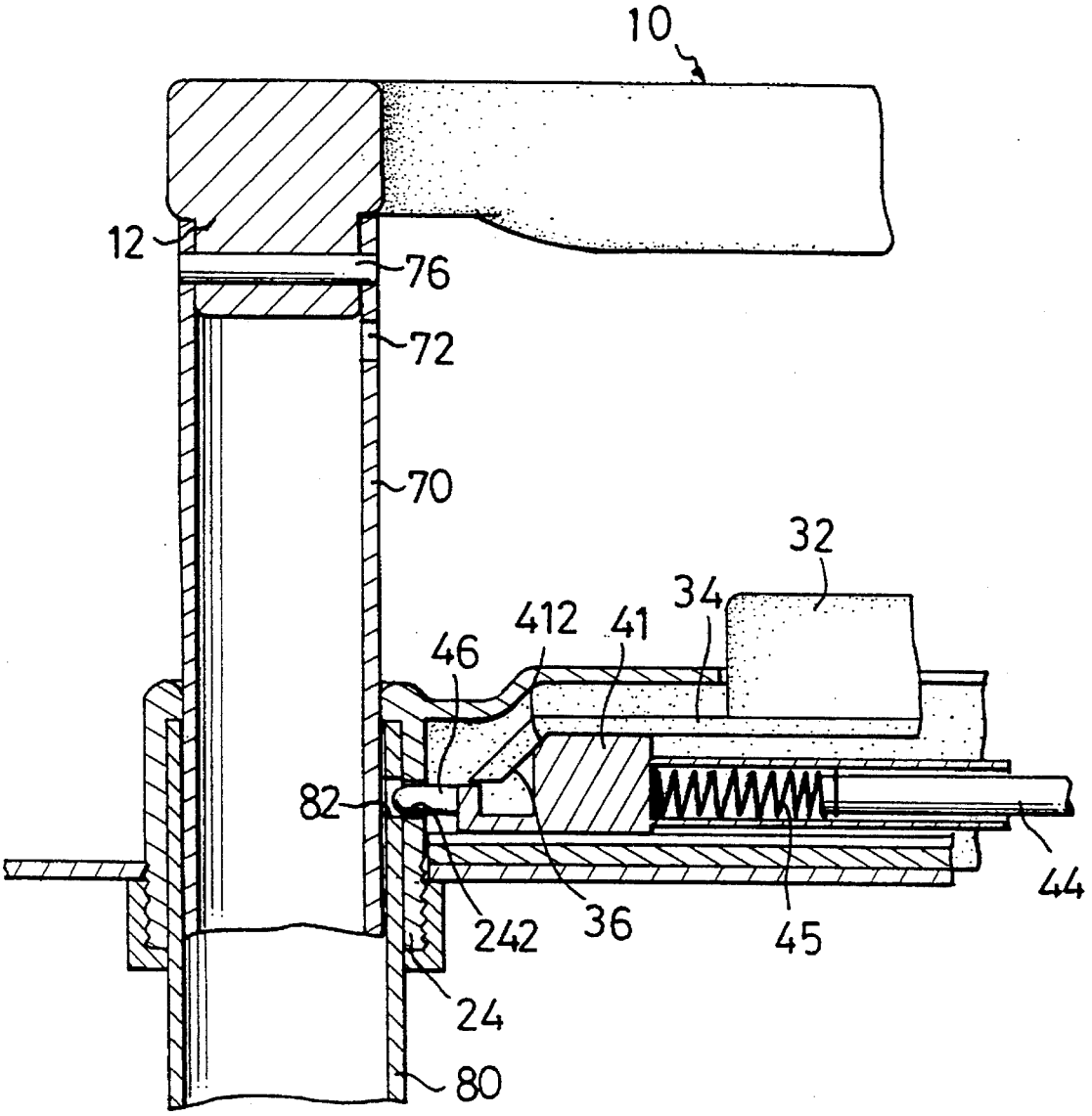
FIG. 5 is an operational view showing the inner tube of the handle assembly being movable in an outer tube.

In operation, referring to FIGS. 4 and 5, each of the stubs 46 is initially urged to be inserted into the third bore 72 of the associated inner tube 70 by means of the spring 45 biasing between the first block 41 and the linking rod 44 of the second block 42 (not shown), thereby locking each of the inner tubes 70 in the associated outer tube 80 as shown in FIG. 4. When the button 32 is pressed downwardly, the first and second blocks 41 and 42 are forced to move toward each other by means of sliding engagement between the slant surfaces 36 and the first and second tapered surfaces 412 and 422 (not shown), thereby compressing the spring 45 and detaching each of the stubs 46 from the associated third bore 72 of the inner tube 70 such that each of the inner tubes 70 is released to be movable freely and upwardly in the associated outer tube 80 by exerting an upward force on the handle portion 10 and the movement is stopped until a fourth bore (not shown) defined in the lower end of each of the two inner tubes 70 aligns with the second bore 82 of the associated outer tube 80 to be inserted by the associated stub 46 by means of the returning force of the spring 45, thereby expanding the handle assembly for use. When not in use, it is easy to retract the handle assembly backwards just by pressing the button 32 downwardly again to detach the stub 46 from the fourth bore of the associated inner tube 70, thereby easily moving the inner tube 70 downwardly to retract the handle assembly.

It should be clear to those skilled in the art that further embodiments of the present invention may be made without departing from the teachings of the present invention.

What is claimed is:

1. A retractable handle assembly for a suitcase which comprises a first half body and a second half body which are detachably coupled together, each of said first and second half bodies having a top plate and a bottom plate, a pair of holes defined in said top plate of said first half body, said handle assembly comprising:

a hollow bracket mounted on said top plate of said first half body and comprising two side walls and two distal end portions, an opening defined in an upperside of said bracket, a pair of lug portions each formed on a corresponding one of the two distal end portions of said hollow bracket and extending downwardly therefrom to be received in a corresponding one of said two holes of said top plate of said first body, a passage vertically defined in each of said two lug portions, a first bore laterally defined in each of said two lug portions and communicating with said passage;

a pair of outer tubes each having an upper end securely received in said passage of a corresponding one of said two lug portions and each having a lower end fixed to a socket formed on said bottom plate of said first half body, the upper end of each of said outer tubes having a second bore laterally defined therein and aligning with said first bore of associated said lug portion;

a pair of inner tubes each slidably mounted in a corresponding one of said two outer tubes and each having an upper end having a third bore laterally defined therein and aligning with said second bore of associated said outer tube;

a substantially U-shaped handle portion detachably mounted on said bracket and having two free end portions each extending downwardly therefrom and each attached to the upper end of a corresponding one of said two inner tubes;

a pressing member movably mounted in said hollow bracket in a vertical manner and comprising a button movably extending through said opening of said hollow bracket and projecting upwardly therefrom, a plate formed on an underside of said button and having two distal ends each having a slant surface formed thereon and extending downwardly and outwardly therefrom; and a biasing member mounted in said hollow bracket and rested on an underside of said pressing member and comprising a first block and a second block slidably mounted in said hollow bracket and movable relative to each other, a first tapered surface and a second tapered surface respectively formed on said first and second blocks and facing outwardly opposite to each other, said first and second tapered surfaces each respectively rested on an underside of a corresponding one of said two slant surfaces of said pressing member, a receiving tube formed on said first block and facing toward said second block, a linking rod formed on said second block and slidably received in said receiving tube of said first block, a spring having a first end securely attached to a free end of said linking rod and a second end urged in said receiving tube, a pair of stubs each formed on a free end of said first and second blocks to move therewith and facing outwardly opposite to each other, each of said pair of stubs capable of respectively detachably extending through said first bore of a corresponding one of said two lug portions, through said second bore of associated said outer tube and through said third bore of associated said inner tube:

whereby, said button of said pressing member is vertically movable between a first position where each of said stubs of said biasing member is inserted into said third bore of associated said inner tube thereby locking each of said inner tubes in place, and a second position where said button is pressed downwardly, thereby forcing said first and second blocks to move toward each other by means of sliding engagement between each of said two slant surfaces and associated said first and second tapered surfaces such that each of said two stubs of said biasing member is detached from said third bore of associated said inner tube and such that each of said two inner tubes is movable in associated said outer tube.

2. The handle assembly in accordance with claim 1, wherein a first sliding base and a second sliding base are respectively formed on an underside of said first and second blocks and, said hollow bracket comprising two elongated guiding grooves each laterally defined in a corresponding one of said two side walls thereof for receiving and guiding said first and second sliding bases and therein.

3. The handle assembly in accordance with claim 2, further comprising a support member securely mounted on an underside of said hollow bracket, a pair of elongated flanges each longitudinally formed on an upperside of said support member and protruding upwardly therefrom to be rested on said first and second sliding bases thereon such that said first and second blocks are able to slide on said support member.

4. The handle assembly in accordance with claim 3, wherein two elongated upward-facing tapered faces are each laterally formed on an underside of a corresponding one of said two side walls of said bracket member, an elongated downward-facing tapered face is laterally formed on each of two sides of said support member for securely urging on a corresponding one of said two upward-facing tapered faces.

* * * * *